US010944152B2

(12) United States Patent
Hsiao et al.

(10) Patent No.: US 10,944,152 B2
(45) Date of Patent: Mar. 9, 2021

(54) ANTENNA STRUCTURE

(71) Applicant: Chiun Mai Communication Systems, Inc., New Taipei (TW)

(72) Inventors: Jia-Hung Hsiao, New Taipei (TW); Shu-Wei Jhang, New Taipei (TW); Wen-Yuan Chen, New Taipei (TW); Chang-Hsin Ou, New Taipei (TW); Ming-Yu Chou, New Taipei (TW); Chia-Ming Liang, New Taipei (TW); Kuo-Lun Huang, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 31 days.

(21) Appl. No.: 16/545,223

(22) Filed: Aug. 20, 2019

(65) Prior Publication Data

US 2020/0076059 A1 Mar. 5, 2020

(30) Foreign Application Priority Data

Aug. 31, 2018 (CN) ..... 201811010843.4

(51) Int. Cl.

| | |
|---|---|
| ***H01Q 1/24*** | (2006.01) |
| ***H01Q 1/12*** | (2006.01) |
| ***H01Q 5/371*** | (2015.01) |
| ***H01Q 21/28*** | (2006.01) |
| ***H01Q 5/335*** | (2015.01) |
| ***H01Q 21/00*** | (2006.01) |

(52) U.S. Cl.

CPC ..... *H01Q 1/243* (2013.01); *H01Q 1/1207* (2013.01); *H01Q 5/335* (2015.01); *H01Q 5/371* (2015.01); *H01Q 21/0006* (2013.01); *H01Q 21/28* (2013.01)

(58) Field of Classification Search

None

See application file for complete search history.

(56) References Cited

U.S. PATENT DOCUMENTS

| | | | | |
|---|---|---|---|---|
| 9,337,539 | B1 * | 5/2016 | Ananthanarayanan | H01Q 5/335 |
| 2018/0062270 | A1 | 3/2018 | Liang et al. | |
| 2018/0358699 | A1 * | 12/2018 | Li | H01Q 11/14 |
| 2019/0260112 | A1 * | 8/2019 | Azad | H01Q 1/243 |
| 2020/0212543 | A1 * | 7/2020 | Zhu | H01Q 5/307 |

FOREIGN PATENT DOCUMENTS

| | | |
|---|---|---|
| CN | 107799909 | 3/2018 |

* cited by examiner

*Primary Examiner* — Jany Richardson

(74) *Attorney, Agent, or Firm* — ScienBiziP, P.C.

(57) ABSTRACT

An antenna structure includes a metal frame. The metal frame includes a first gap, a second gap, a third gap, and a fourth gap to separate a first antenna, a second antenna, a third antenna, and a fourth antenna from the metal frame. The metal frame includes a fifth antenna. The first antenna, the second antenna, the third antenna, and the fourth antenna cooperatively form a first multiple-input multiple-output (MIMO) antenna to provide a 4×4 multiple-input multiple-output function in a second frequency band. The first antenna, the second antenna, the third antenna, and the fifth antenna cooperatively form a second MIMO antenna to provide a 4×4 multiple-input multiple-output function in a third frequency band. The first antenna and the third antenna cooperatively form a third MIMO antenna to provide a 2×2 multiple-input multiple-output function in a first frequency band.

18 Claims, 15 Drawing Sheets

ANTENNA STRUCTURE

FIELD

The subject matter herein generally relates to antenna structures, and more particularly to an antenna structure of an electronic device.

BACKGROUND

Generally, wireless communication devices on the market use a metal frame as the outer frame structure of the wireless communication device, and one or more gaps are defined in the metal frame to separate the metal frame into several segments. The one or more segments are used as an antenna to meet communication band requirements of the wireless communication device. However, such an antenna design may be insufficient due to a multiple-input multiple-output (MIMO) antenna arrangement wherein a number of antennas is multiplied in a narrow wireless communication device environment. The MIMO antenna arrangement puts higher requirements on the isolation between the antennas. Therefore, a design of a MIMO antenna with a large frequency band coverage on the metal frame of the wireless communication device is desired.

BRIEF DESCRIPTION OF THE DRAWINGS

Implementations of the present disclosure will now be described, by way of embodiments, with reference to the attached figures.

DETAILED DESCRIPTION

Figure 1:
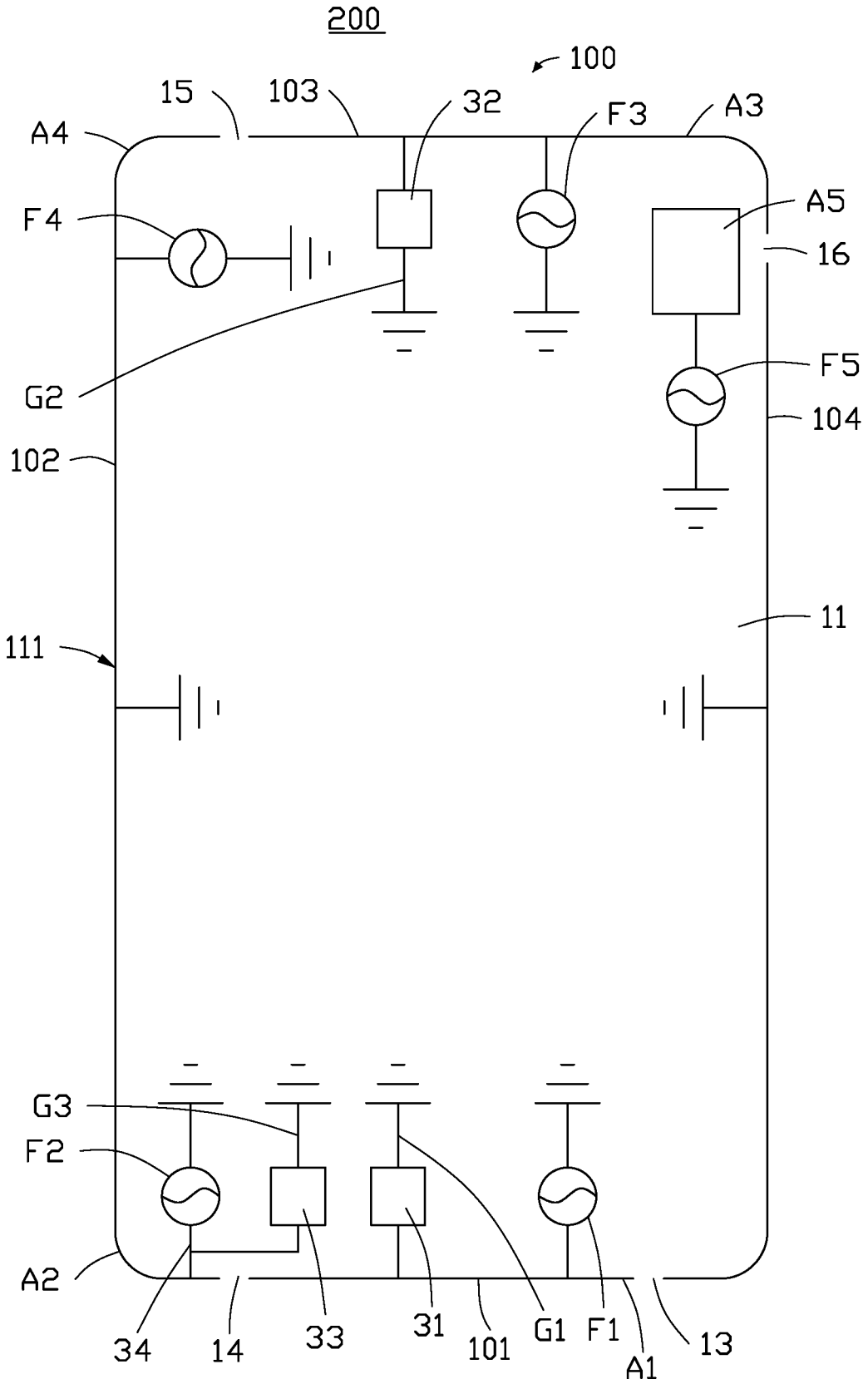
FIG. 1 is a schematic diagram of an antenna structure applied in a wireless communication device according to a first embodiment.

It will be appreciated that for simplicity and clarity of illustration, where appropriate, reference numerals have been repeated among the different figures to indicate corresponding or analogous elements. Additionally, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Several definitions that apply throughout this disclosure will now be presented.

The term "coupled" is defined as connected, whether directly or indirectly through intervening components, and is not necessarily limited to physical connections. The connection can be such that the objects are permanently connected or releasable connected. The term "substantially" is defined to be essentially conforming to the particular dimension, shape, or other word that "substantially" modifies, such that the component need not be exact. For example, "substantially cylindrical" means that the object resembles a cylinder, but can have one or more deviations from a true cylinder. The term "comprising" means "including, but not necessarily limited to"; it specifically indicates open-ended inclusion or membership in a so-described combination, group, series and the like.

FIG. 1 shows an embodiment of an antenna structure 100 applicable in a wireless communication device 200 for transmitting and receiving wireless signals. The wireless communication device 200 can be a mobile phone, a personal digital assistant, or the like.

The antenna structure 100 includes a housing 11, a first feed source F1, a second feed source F2, a third feed source F3, a fourth feed source F4, a fifth feed source F5, a first ground point G1, a second ground point G2, and a third ground point G3. The first feed source F1, the second feed source F2, the third feed source F3, the fourth feed source F4, and the fifth feed source F5 are all mounted within the housing 11 and are configured to supply an electric current to the antenna structure 100. The first ground point G1, the second ground point G2, and the third ground point G3 are mounted within the housing 11 to ground the antenna structure 100.

The housing 11 can be an outer casing of the wireless communication device 200. The housing 11 includes a metal frame 111. The metal frame 111 has a substantially annular structure. The housing 11 can also include a backplane (not shown). The backplane is mounted on the metal frame 111 and defines an accommodating space (not shown) together with the metal frame 111. The accommodating space is used for accommodating electronic components, circuit modules of a circuit board, a processing unit, and the like of the wireless communication device 200.

The metal frame 111 includes a first side 101, a second side 102, a third side 103, and a fourth side 104 coupled together in sequence. In one embodiment, the first side 101 is opposite to the third side 103, and the second side 102 is opposite to the fourth side 104. The first side 101, the second side 102, the third side 103, and the fourth side 104 cooperatively form the annular structure. In one embodiment, the first side 101 is defined as a bottom end of the wireless communication device 200, and the third side 103 is defined as a top end of the wireless communication device 200.

A first gap 13, a second gap 14, a third gap 15, and a fourth gap 16 are defined in the metal frame 111. In one embodiment, the first gap 13 is defined in the first side 101 adjacent to the fourth side 104. The second gap 14 is defined in the first side 101 adjacent to the second side 102. The third gap 15 is defined in the third side 103 adjacent to the second side 102. The fourth gap 16 is defined in the fourth side 104 adjacent to the third side 103. Each of the first gap 13, the second gap 14, the third gap 15, and the fourth gap 16 pass through the metal frame 111 to separate a first antenna A1, a second antenna A2, a third antenna A3, and a fourth antenna A4 from the metal frame 111. In other embodiments, positions of the first gap 13, the second gap 14, the third gap 15, and the fourth gap 16 can be adjusted as needed.

A portion of the metal frame 111 between the first gap 13 and the second gap 14 is defined as the first antenna A1. A portion of the metal frame 111 between the second gap 14 and the third gap 15 that is adjacent to the first antenna A1 is defined as the second antenna A2. A portion of the metal frame 111 between the third gap 15 and the fourth gap 16 is defined as the third antenna A3. A portion of the metal frame 111 between the second gap 14 and the third gap 15 that is adjacent to the third antenna A3 is defined as the fourth antenna A4. A fifth antenna A5 is mounted within the housing 11. The fifth antenna A5 is adjacent to the fourth gap 16. The fifth antenna A5 may be a radiator of any shape.

A portion of the metal frame 111 including the second side 102 between the second gap 14 and the third gap 15 is grounded. A portion of the metal frame 111 including the fourth side 104 between the first gap 13 and the fourth gap 16 is grounded.

In one embodiment, the first gap 13, the second gap 14, the third gap 15, and the fourth gap 16 are filled with an insulating material, such as plastic, rubber, glass, wood, ceramic, or the like.

In one embodiment, the first feed source F1, the second feed source F2, the third feed source F3, the fourth feed source F4, and the fifth feed source F5 are electrically coupled to and supply an electric current to the first antenna A1, the second antenna A2, the third antenna A3, the fourth antenna A4, and the fifth antenna A5, respectively.

When the first feed source F1 supplies an electric current, the electric current from the first feed source F1 flows through the first antenna A1 to excite a first working mode, a second working mode, and a third working mode and generate a radiation signal in a first frequency band, a second frequency band, and a third frequency band. When the second feed source F2 supplies an electric current, the electric current from the second feed source F2 flows through the second antenna A2 to excite the second working mode and the third working mode and generate a radiation signal in the second frequency band and the third frequency band. When the third feed source F3 supplies an electric current, the electric current from the third feed source F3 flows through the third antenna A3 to excite the first working mode, the second working mode, and the third working mode and generate a radiation signal in the first frequency band, the second frequency band, and the third frequency band. When the fourth feed source F4 supplies an electric current, the electric current from the fourth feed source F4 flows through the fourth antenna A4 to excite the second working mode and a fourth working mode and generate a radiation signal in the second frequency band and a fourth frequency band. When the fifth feed source F5 supplies an electric current, the electric current from the fifth feed source F5 flows through the fifth antenna A5 to excite the third working mode and generate a radiation signal in the third frequency band.

In one embodiment, the first antenna A1, the second antenna A2, the third antenna A3, and the fourth antenna A4 cooperatively form a first multiple-input multiple-output (MIMO) antenna to provide a 4×4 multiple-input multiple-output function in the second frequency band. The first antenna A1, the second antenna A2, the third antenna A3, and the fifth antenna A5 cooperatively form a second MIMO antenna to provide a 4×4 multiple-input multiple-output function in the third frequency band. The first antenna A1 and the third antenna A3 cooperatively form a third MIMO antenna to provide a 2×2 multiple-input multiple-output function in the first frequency band.

In one embodiment, the third frequency band is higher than the second frequency band, the second frequency band is higher than the fourth frequency band, and the fourth frequency band is higher than the first frequency band. The first working mode is a Long Term Evolution Advanced (LTE-A) low-frequency mode, and the first frequency band is 699-960 MHz. The second working mode is an LTE-A mid-frequency mode, and the second frequency band is 1710-2200 MHz or 1805-2200 MHz. The third working mode is an LTE-A high-frequency mode, and the third frequency band is 2300-2690 MHz. The fourth working mode is a Global Positioning System (GPS) mode, and the fourth frequency band is 1550-1612 MHz.

Figure 2:
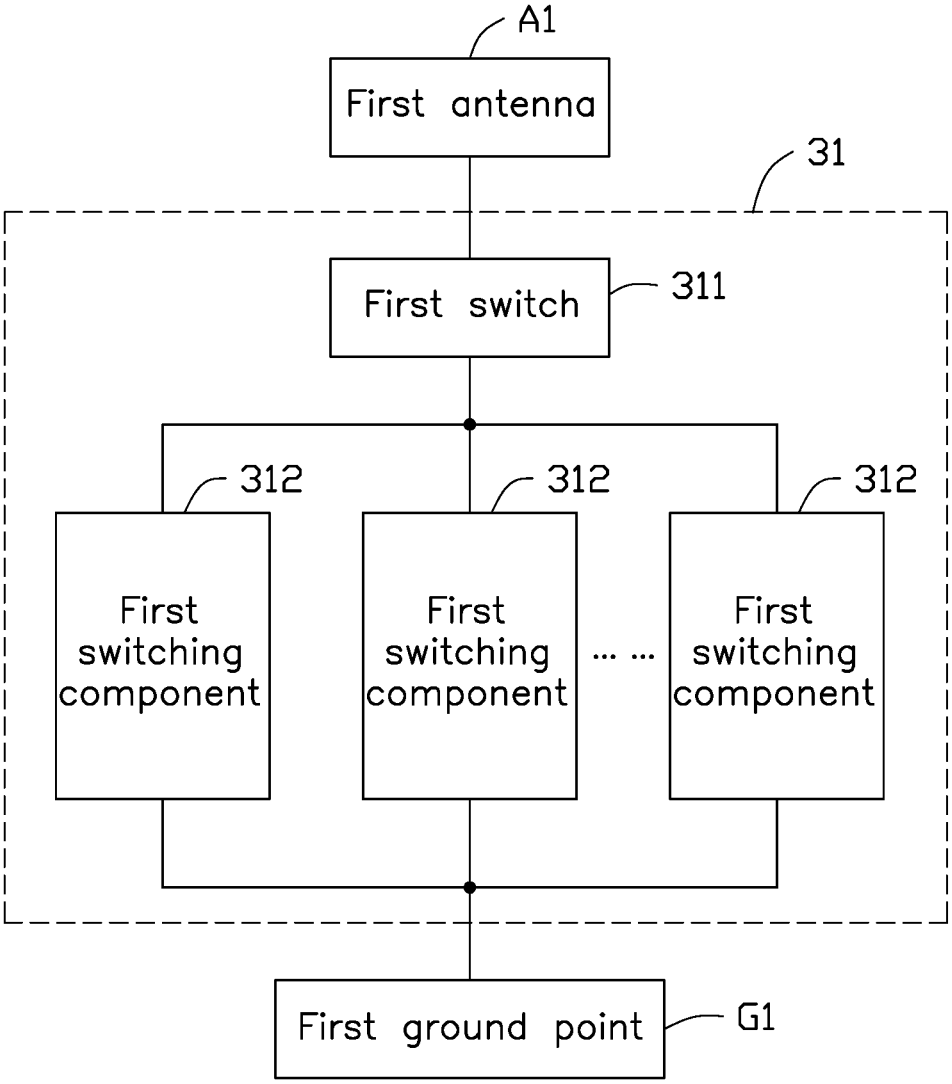
FIG. 2 is a circuit diagram of a first switching circuit in the antenna structure shown in FIG. 1.

As shown in FIG. 2, in one embodiment, the antenna structure 100 further includes a first switching circuit 31. The first switching circuit 31 includes a first switch 311 and a plurality of first switching components 312. The first switch 311 can be a single pole single throw switch, a single pole double throw switch, a single pole triple throw switch, a single pole four-throw switch, a single pole six-throw switch, a single pole eight-throw switch, or the like. The first switch 311 is electrically coupled to the first antenna A1. Each of the first switching components 312 may be an inductor, a capacitor, or a combination of the two. The first switching components 312 are coupled together in parallel. One end of each of the first switching components 312 is electrically coupled to the first switch 311, and a second end of each of the first switching components 312 is electrically coupled to the first ground point G1. Each of the first switching components 312 has different impedances. By controlling the first switch 311, the first switch 311 is switched to electrically couple to a different one of the first switching components 312, thereby adjusting the first frequency band of the first antenna A1. In one embodiment, the plurality of first switching components 312 includes five inductors in parallel, and the inductance values of the five inductors are 10 nH, 13 nH, 18 nH, 23 nH, and 30 nH, respectively.

Figure 3:
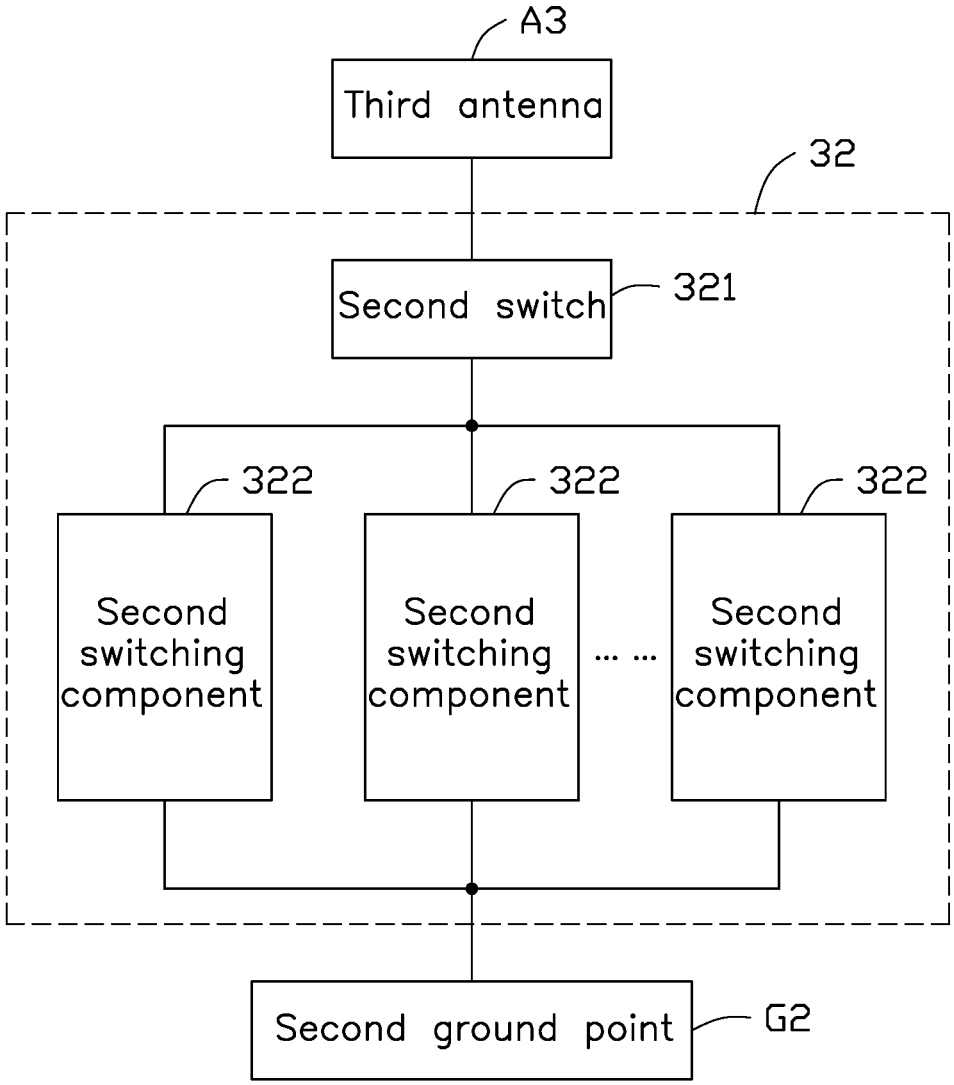
FIG. 3 is a circuit diagram of a second switching circuit in the antenna structure shown in FIG. 1.

As shown in FIG. 3, in one embodiment, the antenna structure 100 further includes a second switching circuit 32. The second switching circuit 32 includes a second switch 321 and a plurality of second switching components 322. The second switch 321 can be a single pole single throw switch, a single pole double throw switch, a single pole triple throw switch, a single pole four-throw switch, a single pole six-throw switch, a single pole eight-throw switch, or the like. The second switch 321 is electrically coupled to the third antenna A3. Each of the second switching components 322 can be an inductor, a capacitor, or a combination of the two. The second switching components 322 are coupled together in parallel. One end of each of the plurality of second switching components 322 is electrically coupled to the second switch 321, and a second end of each of the plurality of second switching components 322 is electrically coupled to the second ground point G2. Each of the second switching components 322 has different impedances. By controlling the second switch 321, the second switch 321 is switched to electrically couple to a different one of the second switching components 322, thereby adjusting the first frequency band of the third antenna A3.

In one embodiment, the antenna structure 100 further includes a third switching circuit 33 and a connecting portion 34. The connecting portion 34 is electrically coupled between the second feed source F2 and the second antenna A2. One end of the third switching circuit 33 is electrically coupled to the third ground point G3. A second end of the third switching circuit 33 is electrically coupled to the connecting portion 34. The connecting portion 34 may be a length of wire formed by a wire on a flexible printed circuit board or a laser direct structure. The third switching circuit 33 is a short circuit when the MIMO function is switched off, and an open circuit when the MIMO function is switched on. The third switching circuit 33 is configured to electrically couple an output end of the second feed source F2 to the third ground point G3 when the multiple-input multiple-output function is switched off to prevent interference of the radiation signal of the first antenna A1.

Figure 4:
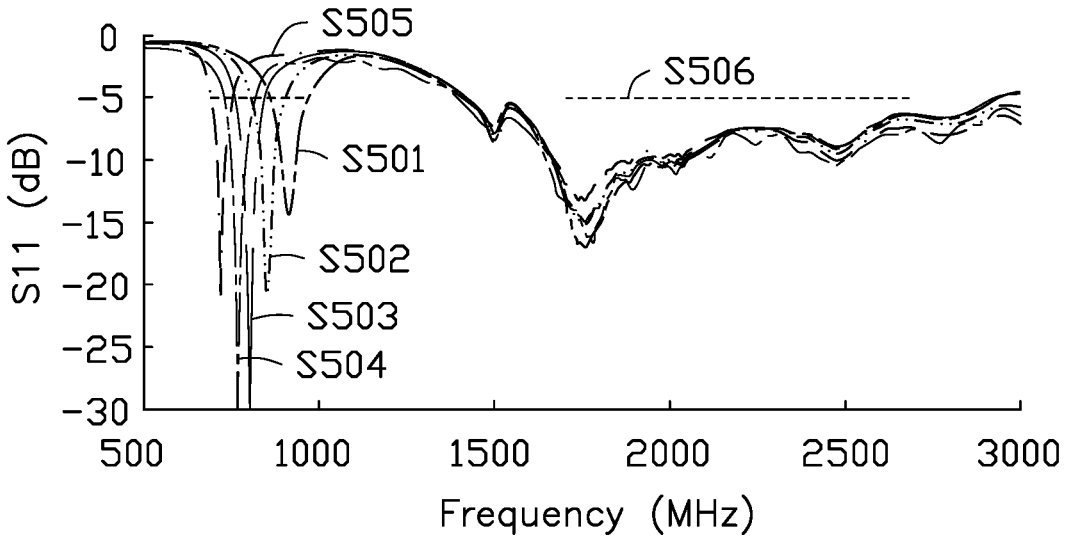
FIG. 4 is a graph of scattering parameters (S11 parameters) of a first antenna in the antenna structure shown in FIG. 1.

FIG. 4 shows a graph of scattering parameters (S11 parameters) when the first antenna A1 operates in the LTE-A low-frequency mode, the LTE-A mid-frequency mode, and the LTE-A high-frequency mode. When the first switch 311 is switched to electrically couple to different ones of the first switching components 312 (such as the first switching components 312 having inductance values of 10 nH, 13 nH, 18 nH, 23 nH, 30 nH, respectively), since the first switching components 312 have different impedance values, the low-frequency band of the first antenna A1 can be effectively adjusted by switching the first switch 311 to electrically couple to the different first switching components 312. A plotline S501 represents S11 parameters of the first antenna A1 operating in the LTE-A low-mid-high-frequency modes when the first switch 311 is switched to the first switching component 312 having an inductance value of 10 nH. A plotline S502 represents S11 parameters of the first antenna A1 operating in the LTE-A low-mid-high-frequency modes when the first switch 311 is switched to the first switching component 312 having an inductance value of 13 nH. A plotline S503 represents S11 parameters of the first antenna A1 operating in the LTE-A low-mid-high-frequency modes when the first switch 311 is switched to the first switching component 312 having an inductance value of 18 nH. Figure. A plotline S504 represents S11 parameters of the first antenna A1 operating in the LTE-A low-mid-high-frequency modes when the first switch 311 is switched to the first switching component 312 having an inductance value of 23 nH. A plotline S505 represents S11 parameters of the first antenna A1 operating in the LTE-A low-mid-high-frequency modes when the first switch 311 is switched to the first switching component 312 having an inductance value of 30 nH. Figure. A plotline S506 is a voltage standing wave ratio (VSWR) of the first antenna A1.

Figure 5:
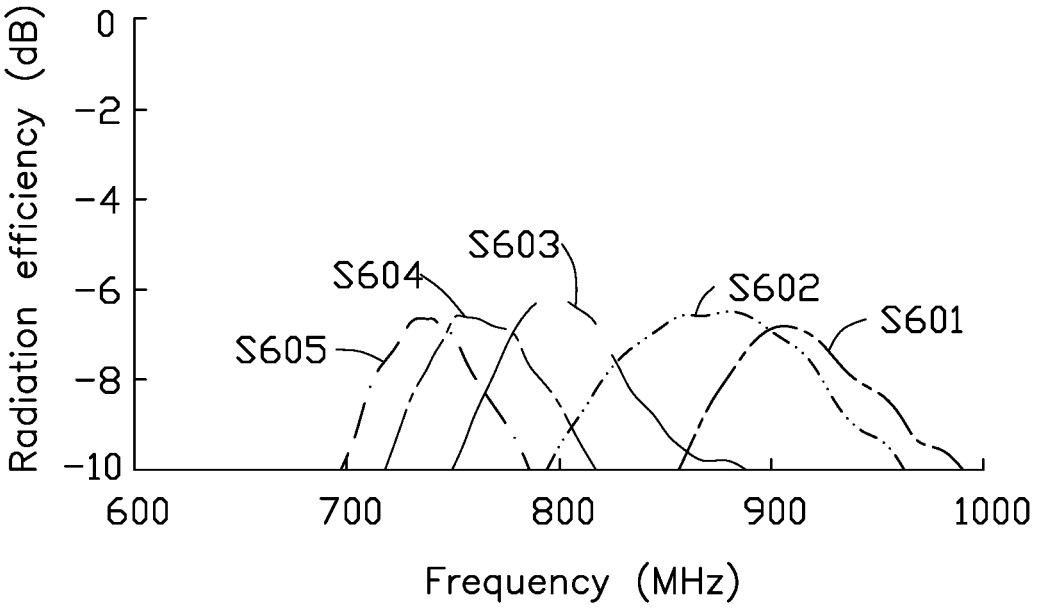
FIG. 5 is a graph of radiation efficiency of the first antenna when the first switch is switched to different first switching components in the first switching circuit shown in FIG. 2.

FIG. 5 shows a graph of radiation efficiency of the first antenna A1 operating in the LTE-A low-frequency mode. A plotline S601 represents radiation efficiency of the first antenna A1 operating in the LTE-A low-frequency mode when the first switch 311 is switched to the first switching component 312 having an inductance value of 10 nH. A plotline S602 represents radiation efficiency of the first antenna A1 operating in the LTE-A low-frequency mode when the first switch 311 is switched to the first switching component 312 having an inductance value of 13 nH. A plotline S603 represents radiation efficiency of the first antenna A1 operating in the LTE-A low-frequency mode when the first switch 311 is switched to the first switching component 312 having an inductance value of 18 nH. A plotline S604 represents radiation efficiency of the first antenna A1 operating in the LTE-A low-frequency mode when the first switch 311 is switched to the first switching component 312 having an inductance value of 23 nH. A plotline S605 represents radiation efficiency of the first antenna A1 operating in the LTE-A low-frequency mode when the first switch 311 is switched to the first switching component 312 having an inductance value of 30 nH.

Figure 6:
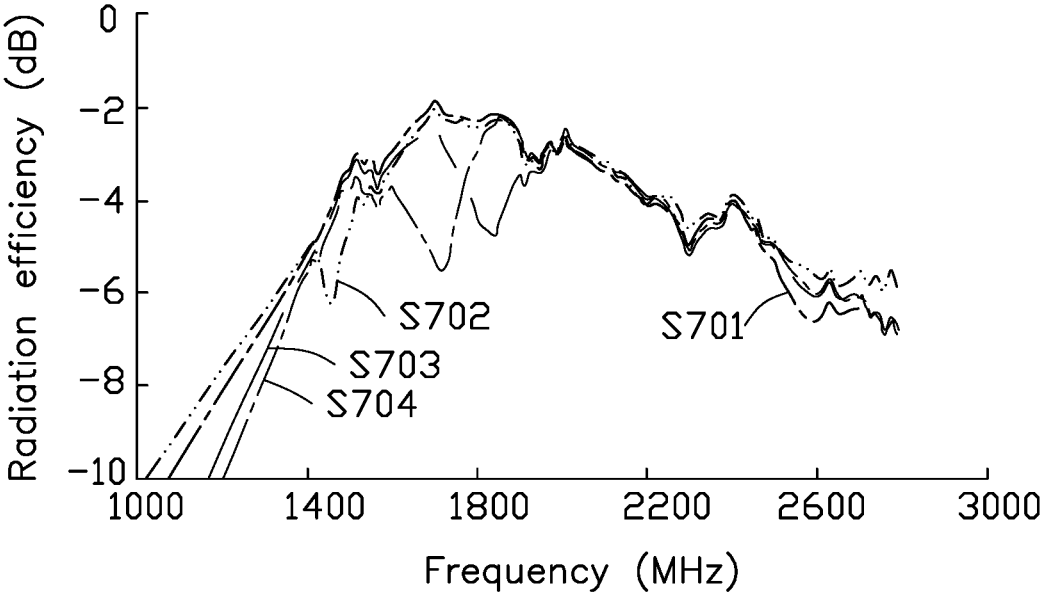
FIG. 6 is a graph of radiation efficiency of the first antenna in the antenna structure shown in FIG. 4 when operating in a Long Term Evolution Advanced (LTE-A) high-frequency mode.

FIG. 6 shows a graph of radiation efficiency of the first antenna A1 operating in the LTE-A high-frequency mode. A plotline S701 represents radiation efficiency of the first antenna A1 operating in the LTE-A high-frequency mode when the first switch 311 is switched to the first switching component 312 having an inductance value of 10 nH. A plotline S702 represents radiation efficiency of the first antenna A1 operating in the LTE-A high-frequency mode when the first switch 311 is switched to the first switching component 312 having an inductance value of 13 nH. A plotline S703 represents radiation efficiency of the first antenna A1 operating in the LTE-A high-frequency mode when the first switch 311 is switched to the first switching component 312 having an inductance value of 18 nH. A plotline S704 represents radiation efficiency of the first antenna A1 operating in the LTE-A high-frequency mode when the first switch 311 is switched to the first switching component 312 having an inductance value of 23 nH.

Figure 7:
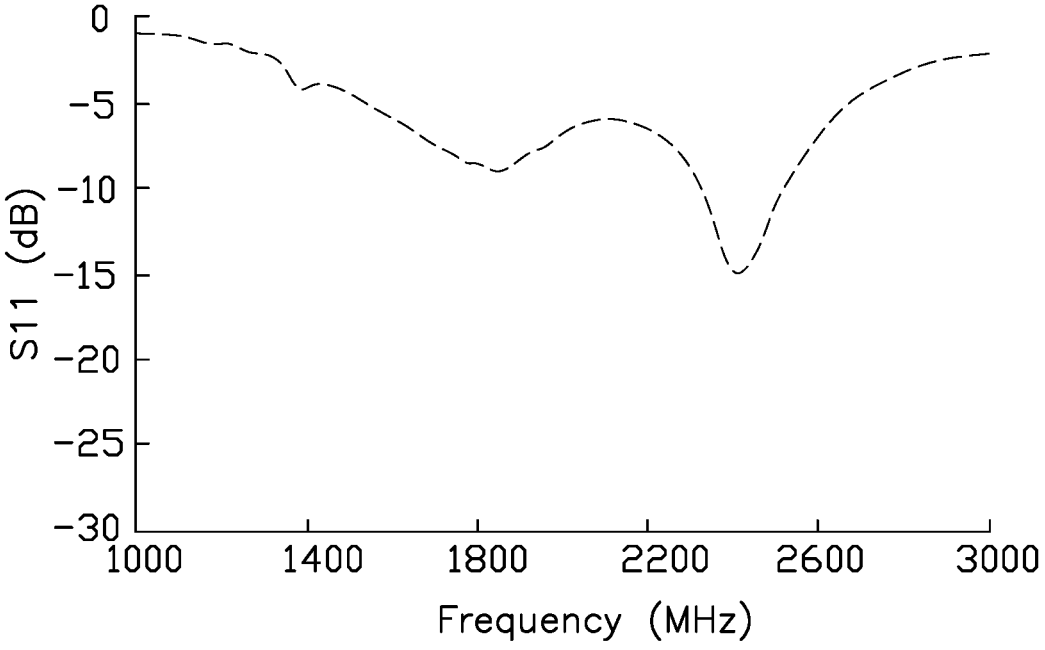
FIG. 7 is a graph of S11 parameters of a second antenna in the antenna structure shown in FIG. 1.

FIG. 7 shows a graph of S11 parameters of the second antenna A2 operating in the LTE-A high-frequency mode.

Figure 8:
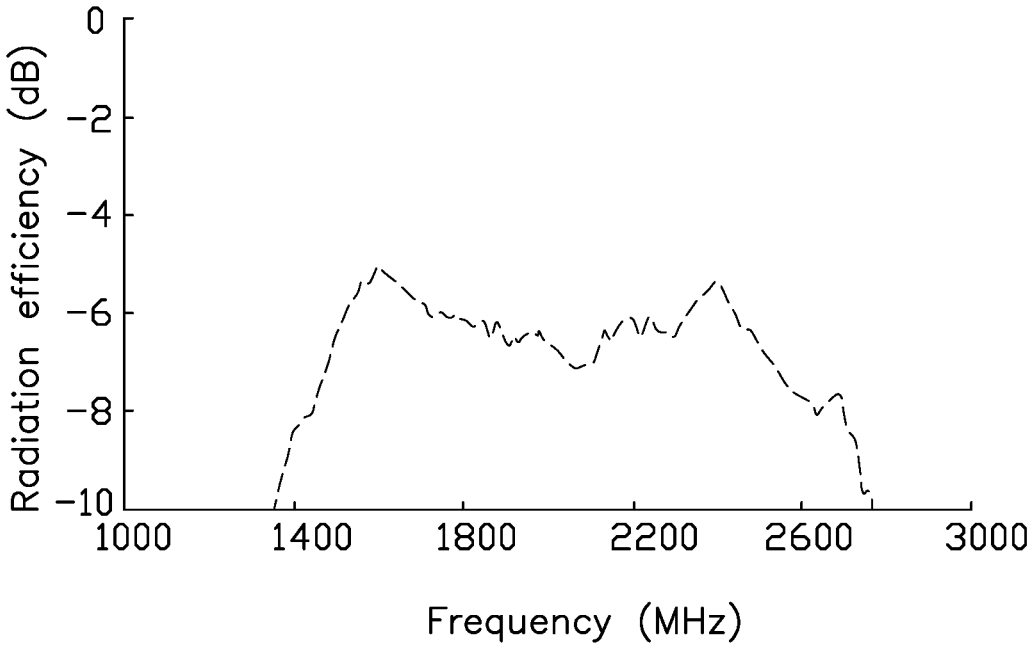
FIG. 8 is a graph of radiation efficiency of the second antenna in the antenna structure shown in FIG. 7.

FIG. 8 shows a graph of radiation efficiency of the second antenna A2 operating in the LTE-A high-frequency mode.

Figure 9:
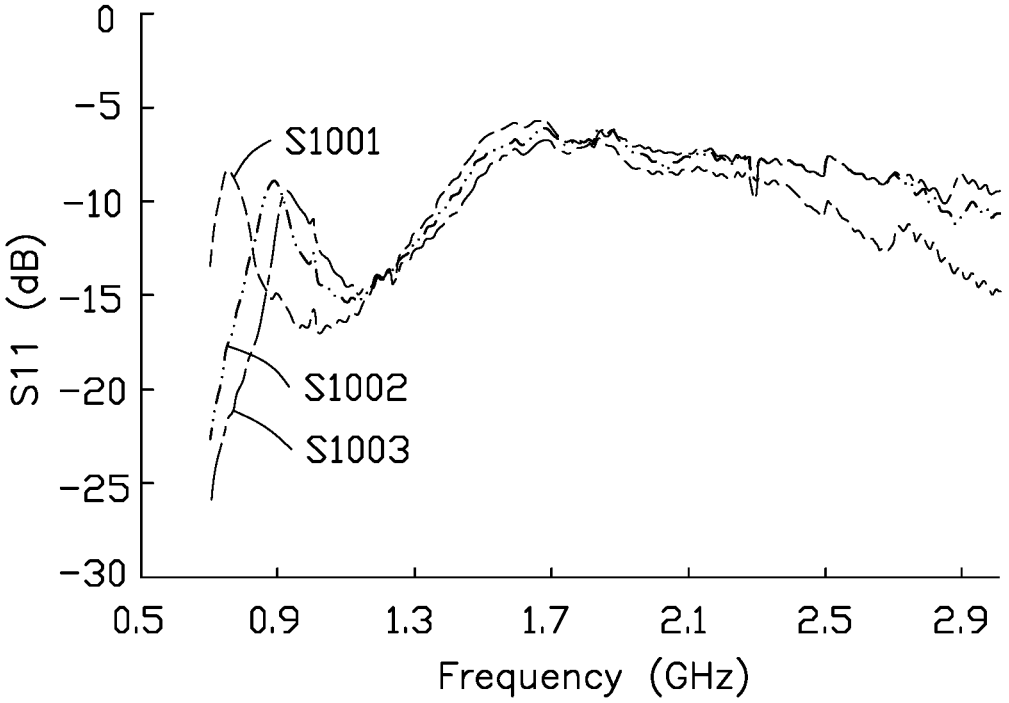
FIG. 9 is a graph of S11 parameters of a third antenna in the antenna structure shown in FIG. 1.

FIG. 9 shows a graph of S11 parameters of the third antenna A3 operating in the LTE-A low-mid-high frequency mode. A plotline S1001 represents S11 parameters of the third antenna A3 operating in the 700 MHz frequency band and the LTE-A mid-high-frequency modes. A plotline S1002 represents S11 parameters of the third antenna A3 operating in the 850 MHz band and the LTE-A mid-high-frequency modes. A plotline S1003 represents S11 parameters of the third antenna A3 operating in the 900 MHz band and the LTE-A mid-high-frequency modes.

Figure 10:
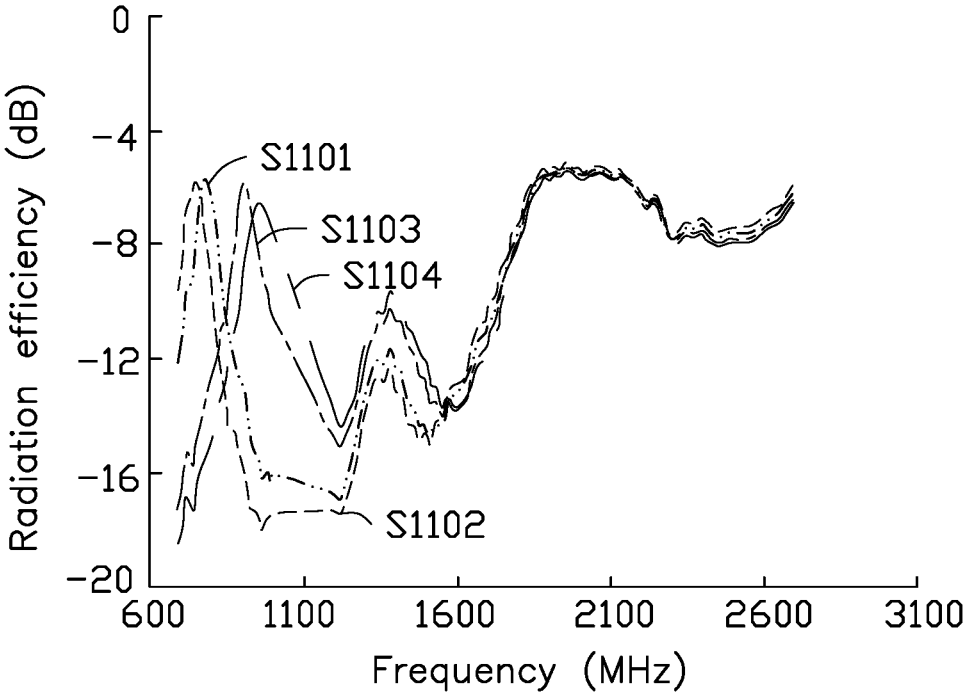
FIG. 10 is a graph of radiation efficiency of the third antenna in the antenna structure shown in FIG. 9.

FIG. 10 shows a graph of radiation efficiency of the third antenna A3 operating in the LTE-A low-mid-high frequency modes. A plotline S1101 represents radiation efficiency of the third antenna A3 operating in the B28 frequency band and the LTE-A mid-high-frequency modes. A plotline S1102 represents radiation efficiency of the third antenna A3 operating in the B13 frequency band and the LTE-A mid-high-frequency modes. A plotline S1103 represents radiation efficiency of the third antenna A3 operating in the B20/B5 frequency band and the LTE-A mid-high-frequency modes. A plotline S1104 represents radiation efficiency of the third antenna A3 operating in the B8 frequency band and the LTE-A mid-high-frequency modes.

Figure 11:
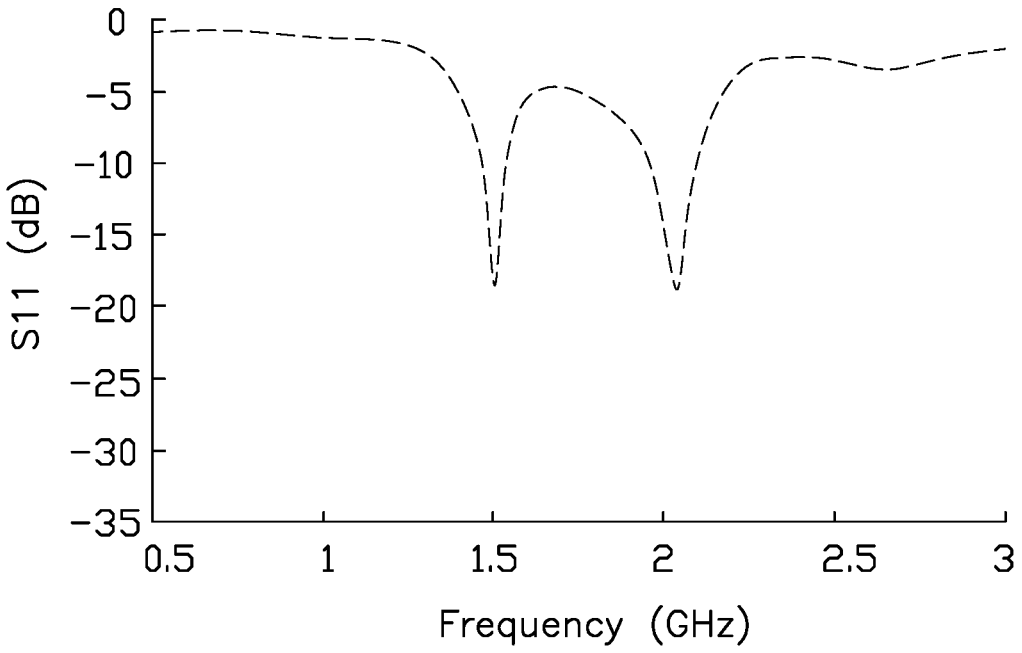
FIG. 11 is a graph of S11 parameters of a fourth antenna in the antenna structure shown in FIG. 1.

FIG. 11 shows a graph of S11 parameters of the fourth antenna A4 operating in the LTE-A mid-frequency mode and the GPS mode.

Figure 12:
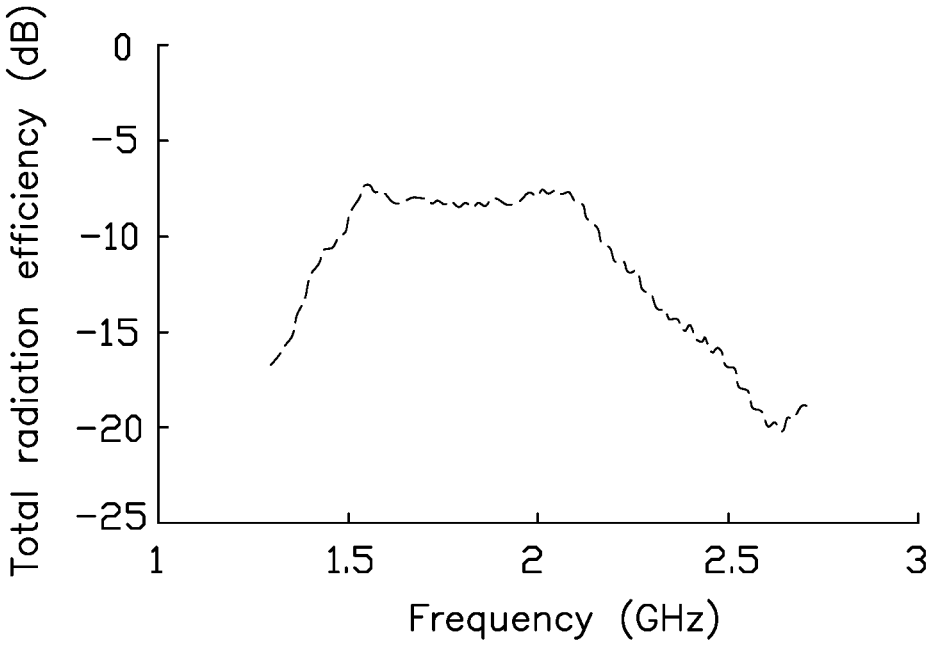
FIG. 12 is a graph of total radiation efficiency of the fourth antenna in the antenna structure shown in FIG. 11.

FIG. 12 shows a graph of total radiation efficiency of the fourth antenna A4 operating in the LTE-A mid-frequency mode and the GPS mode.

Figure 13:
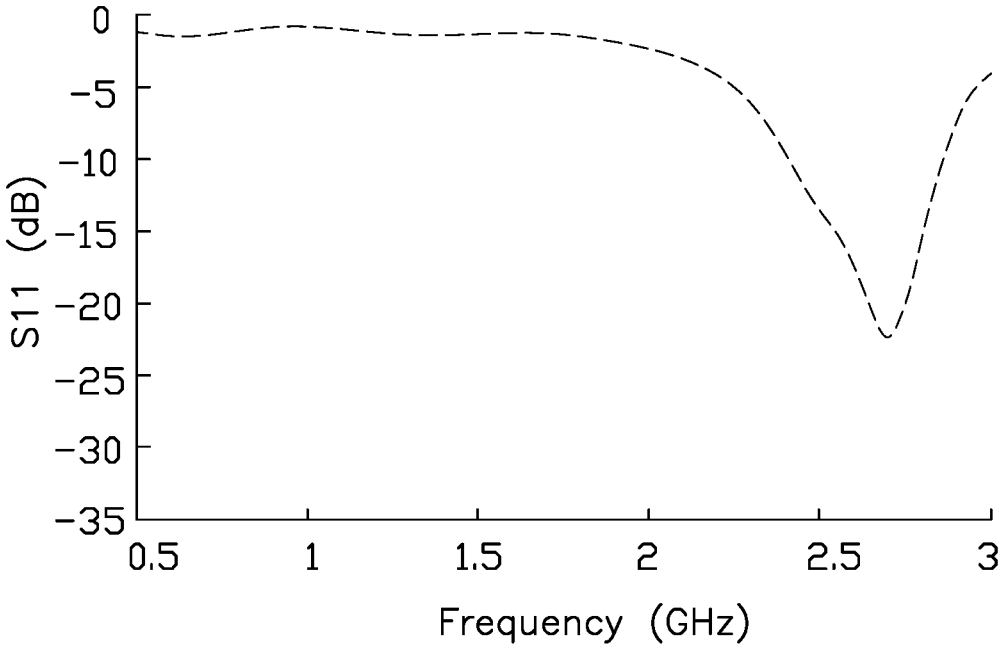
FIG. 13 is a graph of S11 parameters of a fifth antenna in the antenna structure shown in FIG. 1.

FIG. 13 shows a graph of S11 parameters of the fifth antenna A5 operating in the LTE-A high-frequency mode.

Figure 14:
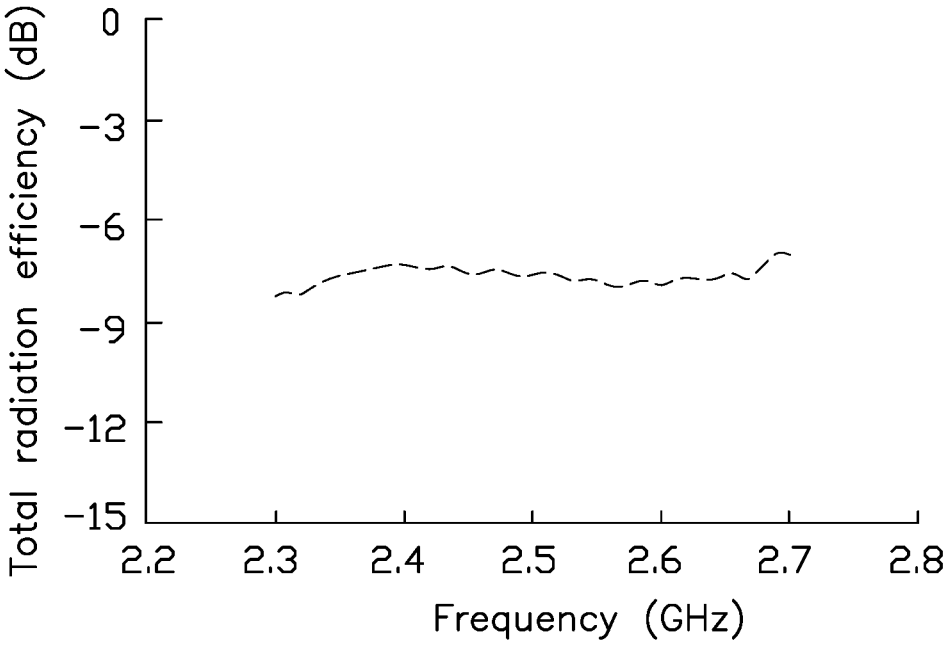
FIG. 14 is a graph of total radiation efficiency of the fifth antenna in the antenna structure shown in FIG. 13.

FIG. 14 shows a graph of total radiation efficiency of the fifth antenna A5 operating in the LTE-A high-frequency mode.

Figure 15:
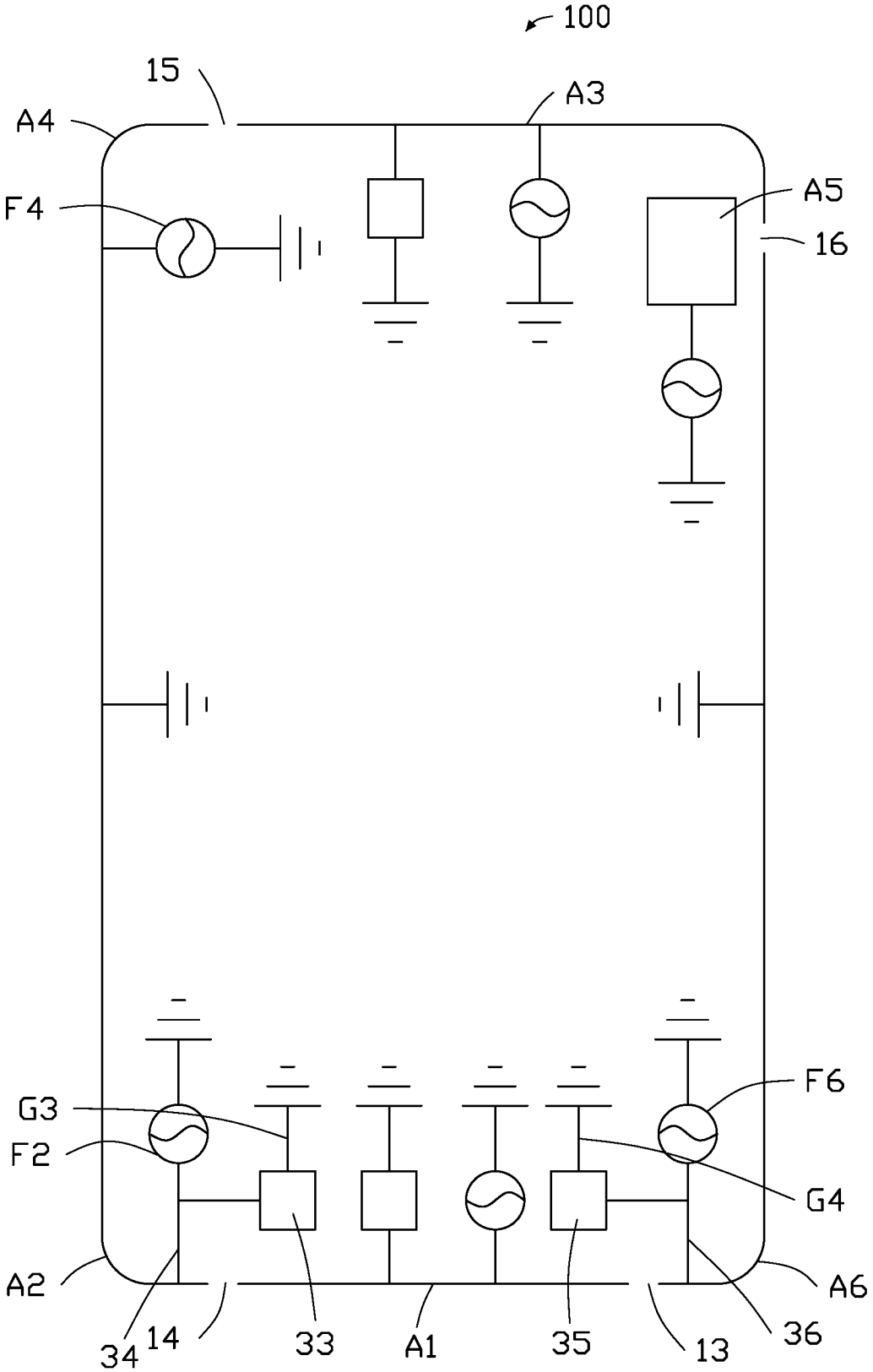
FIG. 15 is a schematic diagram of an antenna structure according to a second embodiment

As shown in FIG. 15, in another embodiment, the antenna structure 100 further includes a sixth antenna A6. A portion of the metal frame 111 between the first gap 13 and the fourth gap 16 and adjacent to the first antenna A1 forms the sixth antenna A6. The sixth antenna A6 and the second antenna A2 have a similar structure. The sixth antenna A6 and the second antenna A2 are symmetrically disposed with respect to the first antenna A1. The antenna structure 100 further includes a sixth feed source F6, a fourth ground point G4, a fourth switching circuit 35, and a coupling portion 36. The coupling portion 36 is electrically coupled between the sixth feed source F6 and the sixth antenna A6. One end of the fourth switching circuit 35 is electrically coupled to the fourth ground point G4. A second end of the fourth switching circuit 35 is electrically coupled to the coupling portion 36. The coupling portion 36 may be a length of wire formed by wire or laser formed on a flexible printed circuit board. The sixth antenna A6 may be used to cover the radiation signals of other frequency bands, such as a 1.5 GHz ultra-mid-frequency band or a WIFI 2.4 GHz frequency band.

As described in the foregoing embodiments, the antenna structure 100 defines a first gap 13, a second gap 14, a third gap 15, and a fourth gap 16 in the metal frame 111. The first gap 13, the second gap 14, the third gap 15, and the fourth gap 16 separate the first antenna A1, the second antenna A2, the third antenna A3, and the fourth antenna A4 from the metal frame 111. A fifth antenna A5 is included inside the housing 11, so that the antenna structure 100 has a large frequency band coverage and can cover the LTE-A low, mid, and high frequency bands, the GPS frequency band, and the WIFI 2.4 GHz frequency band. The first antenna A1, the second antenna A2, the third antenna A3, and the fourth antenna A4 cooperatively form a first multiple-input multiple-output antenna. The first antenna A1, the second antenna A2, the third antenna A3, and the fifth antenna A5 cooperatively form a second multiple-input multiple-output antenna. The first antenna A1 and the third antenna A3 cooperatively form a third multiple-input multiple-output antenna. The three multiple-input multiple-output antennas provide 2×2 and 4×4 multiple-input multiple-output functions.

The embodiments shown and described above are only examples. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including, the full extent established by the broad general meaning of the terms used in the claims.

What is claimed is:

1. An antenna structure comprising:

a metal frame;

at least one feed source;

a first ground point; and a second ground point; wherein:

the metal frame comprises a first gap, a second gap, a third gap, and a fourth gap;

each of the first gap, the second gap, the third gap, and the fourth gap pass through the metal frame to separate a first antenna, a second antenna, a third antenna, and a fourth antenna from the metal frame;

the metal frame comprises a fifth antenna mounted therein;

the first antenna is electrically coupled to the at least one feed source and the first ground point;

the third antenna is electrically coupled to the at least one feed source and the second ground point;

each of the second antenna, the fourth antenna, and the fifth antenna is electrically coupled to the at least one feed source;

the first antenna, the second antenna, the third antenna, and the fourth antenna cooperatively form a first multiple-input multiple-output antenna to provide a 4×4 multiple-input multiple-output function in a second frequency band;

the first antenna, the second antenna, the third antenna, and the fifth antenna cooperatively form a second multiple-input multiple-output antenna to provide a 4×4 multiple-input multiple-output function in a third frequency band; and the first antenna and the third antenna cooperatively form a third multiple-input multiple-output antenna to provide a 2×2 multiple-input multiple-output function in a first frequency band.

2. The antenna structure of claim 1, wherein:

the at least one feed source comprises a first feed source, a second feed source, a third feed source, a fourth feed source, and a fifth feed source;

when the first feed source supplies an electric current, the electric current from the first feed source flows through the first antenna to excite a first working mode, a second working mode, and a third working mode and generate a radiation signal in a first frequency band, a second frequency band, and a third frequency band;

when the second feed source supplies an electric current, the electric current from the second feed source flows through the second antenna to excite the second working mode and the third working mode and generate a radiation signal in the second frequency band and the third frequency band;

when the third feed source supplies an electric current, the electric current from the third feed source flows through the third antenna to excite the first working mode, the second working mode, and the third working mode and generate a radiation signal in the first frequency band, the second frequency band, and the third frequency band;

when the fourth feed source supplies an electric current, the electric current from the fourth feed source flows through the fourth antenna to excite the second working mode and a fourth working mode and generate a radiation signal in the second frequency band and a fourth frequency band; and when the fifth feed source supplies an electric current, the electric current from the fifth feed source flows through the fifth antenna to excite the third working mode and generate a radiation signal in the third frequency band.

3. The antenna structure of claim 2, wherein:

the first working mode is a Long Term Evolution Advanced (LTE-A) low-frequency mode;

the second working mode is an LTE-A mid-frequency mode;

the third working mode is an LTE-A high-frequency mode;

the fourth working mode is a Global Positioning System (GPS) working mode;

the third frequency band is higher than the second frequency band;

the second frequency band is higher than the fourth frequency band; and the fourth frequency band is higher than the first frequency band.

4. The antenna structure of claim 1 further comprising a first switching circuit, wherein:

the first switching circuit comprises a first switch and a plurality of first switching components;

the first switch is electrically coupled to the first antenna;

the plurality of first switching components are coupled together in parallel;

one end of each of the plurality of first switching components is electrically coupled to the first switch, and a second end of each of the plurality of first switching components is electrically coupled to the first ground point;

each of the first switching components comprise different impedances;

the first switch is controlled to electrically couple to different ones of the plurality of first switching components to adjust the first frequency band of the first antenna.

5. The antenna structure of claim 1 further comprising a second switching circuit, wherein:

the second switching circuit comprises a second switch and a plurality of second switching components;

the second switch is electrically coupled to the third antenna;

the plurality of second switching components are coupled together in parallel;

one end of each of the plurality of second switching components is electrically coupled to the second switch, and a second end of each of the plurality of first switching components is electrically coupled to the second ground point;

each of the second switching components comprises different impedances;

the second switch is controlled to electrically couple to different ones of the plurality of second switching components to adjust the first frequency band of the third antenna.

6. The antenna structure of claim 2 further comprising a third switching circuit, a coupling portion, and a third ground point, wherein:

the coupling portion is electrically coupled between the second feed source and the second antenna;

one end of the third switching circuit is electrically coupled to the third ground point, and a second end of the third switching circuit is coupled to the coupling portion;

the third switching circuit is configured to ground an output end of the second feed source.

7. The antenna structure of claim 1, wherein the first gap, the second gap, the third gap, and the fourth gap are filled with insulating material.

8. The antenna structure of claim 1, wherein:

a portion of the metal frame between the first gap and the second gap is defined as the first antenna;

a portion of the metal frame between the third gap and the fourth gap is defined as the third antenna;

a portion of the metal frame between the second gap and the third gap and adjacent to the first antenna is defined as the second antenna;

a portion of the metal frame between the second gap and the third gap and adjacent to the third antenna is defined as the fourth antenna; and the fifth antenna is adjacent to the fourth gap.

9. The antenna structure of claim 8 further comprising a sixth antenna, wherein a portion of the metal frame between the first gap and the fourth gap and adjacent to the first antenna is defined as the sixth antenna.

10. A wireless communication device comprising an antenna structure, wherein the antenna structure comprises:

a metal frame;

at least one feed source;

a first ground point; and a second ground point; wherein:

the metal frame comprises a first gap, a second gap, a third gap, and a fourth gap;

each of the first gap, the second gap, the third gap, and the fourth gap pass through the metal frame to separate a first antenna, a second antenna, a third antenna, and a fourth antenna from the metal frame;

the metal frame comprises a fifth antenna mounted therein;

the first antenna is electrically coupled to the at least one feed source and the first ground point;

the third antenna is electrically coupled to the at least one feed source and the second ground point;

each of the second antenna, the fourth antenna, and the fifth antenna is electrically coupled to the at least one feed source;

the first antenna, the second antenna, the third antenna, and the fourth antenna cooperatively form a first multiple-input multiple-output antenna to provide a 4×4 multiple-input multiple-output function in a second frequency band;

the first antenna, the second antenna, the third antenna, and the fifth antenna cooperatively form a second multiple-input multiple-output antenna to provide a 4×4 multiple-input multiple-output function in a third frequency band; and the first antenna and the third antenna cooperatively form a third multiple-input multiple-output antenna to provide a 2×2 multiple-input multiple-output function in a first frequency band.

11. The wireless communication device of claim 10, wherein:

the at least one feed source comprises a first feed source, a second feed source, a third feed source, a fourth feed source, and a fifth feed source;

when the first feed source supplies an electric current, the electric current from the first feed source flows through the first antenna to excite a first working mode, a second working mode, and a third working mode and generate a radiation signal in a first frequency band, a second frequency band, and a third frequency band;

when the second feed source supplies an electric current, the electric current from the second feed source flows through the second antenna to excite the second working mode and the third working mode and generate a radiation signal in the second frequency band and the third frequency band;

when the third feed source supplies an electric current, the electric current from the third feed source flows through the third antenna to excite the first working mode, the second working mode, and the third working mode and generate a radiation signal in the first frequency band, the second frequency band, and the third frequency band;

when the fourth feed source supplies an electric current, the electric current from the fourth feed source flows through the fourth antenna to excite the second working mode and a fourth working mode and generate a radiation signal in the second frequency band and a fourth frequency band; and when the fifth feed source supplies an electric current, the electric current from the fifth feed source flows through the fifth antenna to excite the third working mode and generate a radiation signal in the third frequency band.

12. The wireless communication device of claim 11, wherein:

the first working mode is a Long Term Evolution Advanced (LTE-A) low-frequency mode;

the second working mode is an LTE-A mid-frequency mode;

the third working mode is an LTE-A high-frequency mode;

the fourth working mode is a Global Positioning System (GPS) working mode;

the third frequency band is higher than the second frequency band;

the second frequency band is higher than the fourth frequency band; and the fourth frequency band is higher than the first frequency band.

13. The wireless communication device of claim 10, wherein:

the antenna structure further comprises a first switching circuit;

the first switching circuit comprises a first switch and a plurality of first switching components;

the first switch is electrically coupled to the first antenna;

the plurality of first switching components are coupled together in parallel;

one end of each of the plurality of first switching components is electrically coupled to the first switch, and a second end of each of the plurality of first switching components is electrically coupled to the first ground point;

each of the first switching components comprises different impedances;

the first switch is controlled to electrically couple to different ones of the plurality of first switching components to adjust the first frequency band of the first antenna.

14. The wireless communication device of claim 10, wherein:

the antenna structure further comprises a second switching circuit;

the second switching circuit comprises a second switch and a plurality of second switching components;

the second switch is electrically coupled to the third antenna;

the plurality of second switching components are coupled together in parallel;

one end of each of the plurality of second switching components is electrically coupled to the second switch, and a second end of each of the plurality of first switching components is electrically coupled to the second ground point;

each of the second switching components comprises different impedances;

the second switch is controlled to electrically couple to different ones of the plurality of second switching components to adjust the first frequency band of the third antenna.

15. The wireless communication device of claim 11, wherein:

the antenna structure further comprises a third switching circuit, a coupling portion, and a third ground point;

the coupling portion is electrically coupled between the second feed source and the second antenna;

one end of the third switching circuit is electrically coupled to the third ground point, and a second end of the third switching circuit is coupled to the coupling portion;

the third switching circuit is configured to ground an output end of the second feed source.

16. The wireless communication device of claim 10, wherein the first gap, the second gap, the third gap, and the fourth gap are filled with insulating material.

17. The wireless communication device of claim 10, wherein:

a portion of the metal frame between the first gap and the second gap is defined as the first antenna;

a portion of the metal frame between the third gap and the fourth gap is defined as the third antenna;

a portion of the metal frame between the second gap and the third gap and adjacent to the first antenna is defined as the second antenna;

a portion of the metal frame between the second gap and the third gap and adjacent to the third antenna is defined as the fourth antenna; and the fifth antenna is adjacent to the fourth gap.

18. The wireless communication device of claim 17, wherein:

the antenna structure further comprises a sixth antenna; and a portion of the metal frame between the first gap and the fourth gap and adjacent to the first antenna is defined as the sixth antenna.

* * * * *